US006881100B2

(12) United States Patent
Barry et al.

(10) Patent No.: US 6,881,100 B2
(45) Date of Patent: Apr. 19, 2005

(54) MODULAR SOCKET

(75) Inventors: John Brett Barry, Downers Grove, IL (US); Michael G. Amaro, Naperville, IL (US); Mark Daniel Fleszewski, Midlothian, IL (US)

(73) Assignee: Texas Instruments Incorporation, Dallas, TX (US)

( * ) Notice: Subject to any disclaimer, the term of this patent is extended or adjusted under 35 U.S.C. 154(b) by 88 days.

(21) Appl. No.: 10/270,763

(22) Filed: Oct. 15, 2002

(65) Prior Publication Data

US 2004/0072472 A1 Apr. 15, 2004

(51) Int. Cl.[7] ..... H01R 13/502; H01R 13/1514; H01R 9/22

(52) U.S. Cl. ..... 439/701; 439/712

(58) Field of Search ..... 439/701, 704, 439/712, 715, 717, 722, 724

(56) References Cited

U.S. PATENT DOCUMENTS 3,760,336 A * 9/1973 Cerwin ..... 439/363
4,368,939 A * 1/1983 Foederer ..... 439/594
4,425,018 A * 1/1984 Stenz ..... 439/716
4,469,393 A * 9/1984 Chewning et al. ..... 439/717
5,904,598 A * 5/1999 Yamanashi ..... 439/701
6,048,230 A * 4/2000 Kikuchi ..... 439/682
6,193,550 B1 * 2/2001 Yamashita et al. ..... 439/594
6,332,813 B1 * 12/2001 Okabe et al. ..... 439/701

* cited by examiner

*Primary Examiner*—Chandrika Prasad
(74) *Attorney, Agent, or Firm*—W. Daniel Swayze, Jr.; W. James Brady; Frederick J. Telecky, Jr.

(57) ABSTRACT

A socket for receiving a line of contact pins is formed of modules connected together. The modules have three, four or five pin receiving openings and are joined to one another by dovetail connectors to form an elongated body having the desired number of pin receiving openings. Contacts are provided in the pin receiving openings to electrically connect with the pins. The modules have a ledge on which rests a work surface.

1 Claim, 4 Drawing Sheets

MODULAR SOCKET

BACKGROUND OF THE INVENTION

1. Field of the Invention

The present invention relates generally a socket for connecting electrical devices having rows of contact pins, and in particular to a modular socket for receiving contact pins.

2. Description of the Related Art

Electronic devices, such as electronic modules, semiconductor chips and components, have contact pins for electrical connections between the circuitry within the device and circuitry, power supplies and the like outside the device. The contact pins may be soldered in to openings in circuit boards, or may be inserted into sockets where the pins are electrically and physically connected. Such sockets permit the electrical connections to be may quickly and permit exchange of the devices, such as by removal of the device from the socket and insertion of the pins of a different device into the socket.

Sockets are particularly useful on test benches and for burn in operations, where quick connection and disconnection to circuit devices is desired.

Sockets generally must be constructed with the same number and arrangement of sockets as the pins on the device to be connected to the socket. This custom sockets are required for each pin arrangement.

SUMMARY OF THE INVENTION

A modular socket body is provided which is selectively connectable to other modular socket bodies to form a socket assembly for receiving pins of an electrical device. The socket bodies have pin receiving openings and are joined to one another to provide the desired number of pin receiving openings for the socket assembly.

DETAILED DESCRIPTION OF THE PREFERRED EMBODIMENTS

Figure 1:
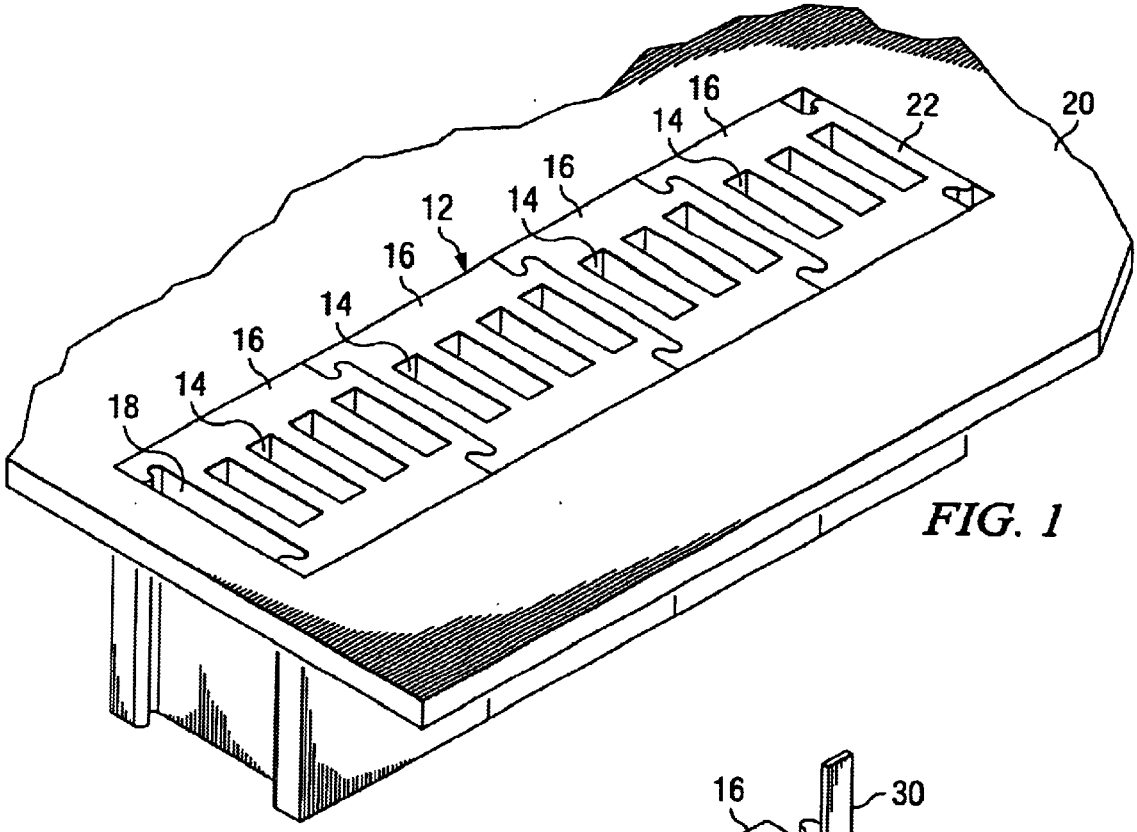
FIG. 1 is a perspective view of a socket assembly for receiving a row of pins according to the principles of the present invention.

Referring first to FIG. 1, a socket assembly 12 is provided for receiving a row of pins of an electronic device. The electronic device may be a circuit chip, a sub-assembly, a daughter board or other electronic assembly. The electronic device may also be an electro-mechanical device, having relays and the like. The electronic device may have pins in one, two or more rows, which are received into pin receiving openings 14 of the socket assembly 12. The pin receiving openings 14 are aligned in a row in an elongated body of the socket assembly 12. The pin receiving openings 14 have a narrow dimension in a longitudinal direction of the elongated body and a greater dimension in a direction transverse to the elongated body. The elongated body of the socket assembly 12 is made up of a plurality of socket bodies 16 joined together end-to-end. Four such socket bodies 16 are joined to from the illustrated socket assembly 12, although other numbers may of course be joined as needed. The socket bodies 16 of FIG. 1 include two socket bodies 16 with four pin receiving openings 14 and two other socket bodies with three pin receiving openings 14.

The elongated body 12 is mounted in an opening 18 of a work surface 20. The top surface 22 of the elongated body 12 is flush with the work surface 20, although it is foreseeable that the elongated socket body 12 may be recessed below the work surface 20 or may extend above the work surface 20. The work surface 20 may be part of a housing, may be a planar work table portion or some other surface.

Pins of the electrical device are plugged into the socket assembly 12 to establish an electrical contact between the circuitry of the electrical device and, for example, test equipment. The present socket assembly 12 may be provided for establishing any type of electrical connections, but is particularly well adapted to use on test benches and circuit burn-in facilities.

The work surface 20 may provide support for the device being connected to the socket. It is foreseen that the work surface 20 may be flat and smooth, or may be textured and/or shaped, as required.

Figure 2:
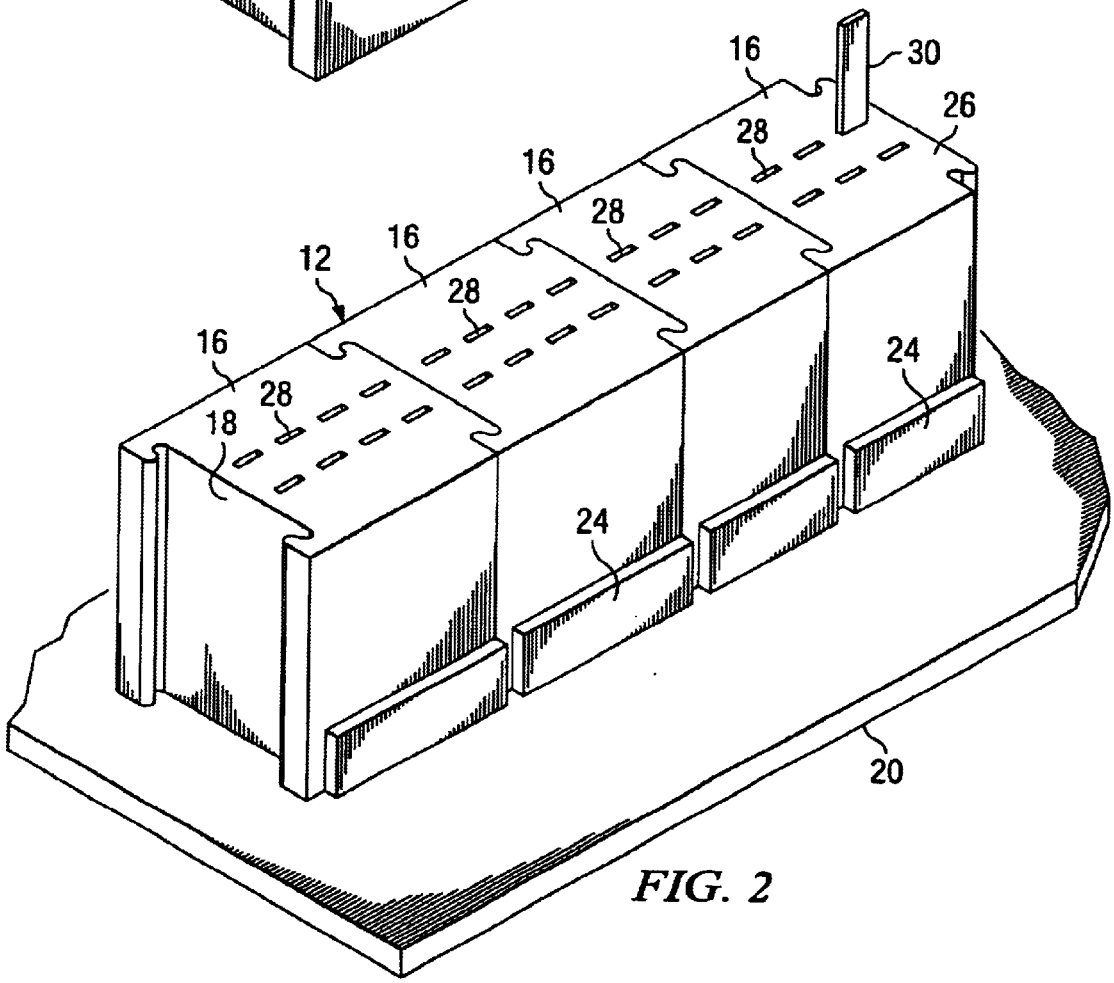
FIG. 2 is a bottom perspective view of the socket assembly of FIG. 1.

In FIG. 2, the elongated socket assembly 12 is shown from the bottom. The socket assembly 12 is mounted in the opening 18 in the work surface 20 with the underside of the work surface 20 resting on ledges 24 on the socket assembly. The ledges 24 extend along the two opposite long sides of the elongated body 12. The elongated body 12 extends below the underside of the work surface 20 to a bottom surface 26 of the socket assembly 12. The bottom surface 26 has openings 28 in two rows along the longitudinal direction of the elongated socket assembly 12. Contacts 30, only one of which is shown for the sake of simplicity, extend from the openings 28.

FIGS. 1 and 2 show the elongated socket 12 formed of a plurality of socket bodies 16, in particular four socket bodies. Two of the four socket bodies have four pin receiving openings each, and the other two have three pin receiving openings each. As can be seen by comparing FIGS. 1 and 2, two of the bottom openings 28 are provided for each of the pin receiving openings 14.

The bottom surfaces 26 of the socket bodies 16 generally rest on a supporting surface when in use and so the socket bodies 16 are supported to resist the insertion force of pins being inserted into the pin receiving openings 14. The ledges 24 on the socket bodies 16 support that socket bodies as they resist the removal force of the pins from the pin receiving openings 14. Durability of the socket assembly is thereby provided.

Figure 3:
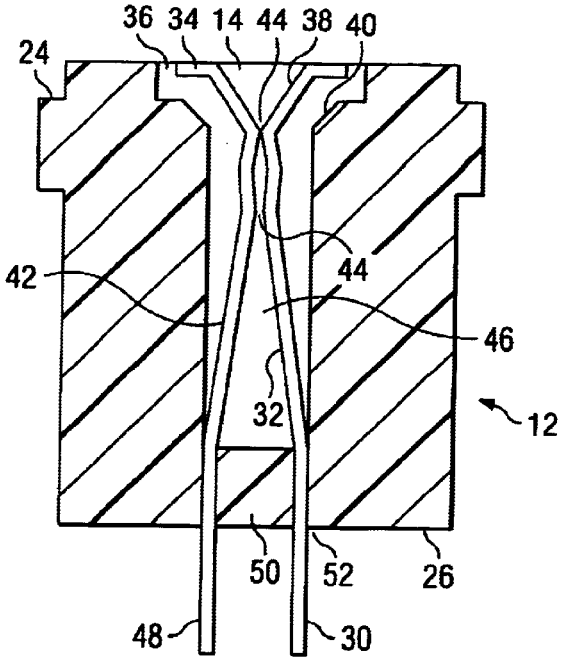
FIG. 3 is a cross section through a pin receiving opening of the socket assembly of FIG. 1.

FIG. 3 shows the interior of the pin receiving opening 14 in the socket assembly 12. Specifically, the pin receiving opening 14 has two contacts 32 mounted facing one another and biased toward one another to provide receive a pin from the electronic device therebetween. The pin receiving opening 14 and the contacts 32 are provided with complementary shapes, so that the contacts have top flanges 34 and the pin receiving opening has a wide top portion 36 corresponding to the flanges. The contacts 32 have angled portions 38 below the flanges 34 to guide the pin into place, and the pin receiving opening 14 has a corresponding beveled portion 40. The contacts 32 have shaft portions 42 with contact points 44 and the pin receiving opening 14 has a shaft portion 46 in which the contact shafts 42 are provided. The contacts have mounting portions 48 and the pin receiving opening 14 has a substantially closed bottom 50 with openings 52 in which the mounting portions 48 are mounted. The contacts lastly have connecting portions 30 extending from the bottom surface 26 of the socket assembly that are electrically connected to test equipment or the like by soldering, wire wrap or other electrical connection.

The socket body 16, in cross section, has a generally rectangular outside shape and the ledges 24 extend from either side thereof. Other shapes are, of course, possible.

Figure 4:
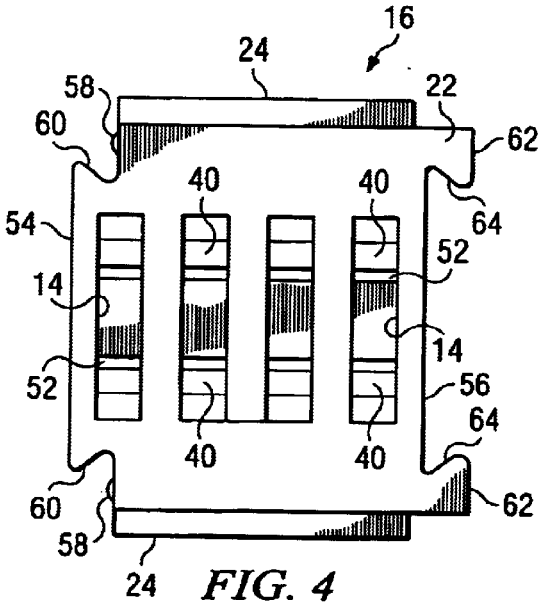
FIG. 4 is top plan view of a socket body for receiving four pins that forms part of the socket assembly of FIG. 1.

An individual one of the socket bodies 16 is shown in FIG. 4 having the top surface 22 in which is provided four pin receiving openings 14. The pin receiving openings 14 are shown without the contacts mounted therein, so that the lower openings 52 are visible. The ledges 24 are provided on the opposite sides of the socket body 26 in the transverse direction. In the longitudinal direction, the ends are provided with coupling shapes including a projection 54 at one end and a recess 56 at the opposite end. The coupling shapes 54 and 56 permit a friction fit coupling of the socket bodies 16 together to form the elongated socket assembly 12. The projection 54 of the illustrated embodiment is wider than the transverse extent of the pin receiving openings 14 so that the endmost pin receiving opening 14 extends into the projection 54. This permits the socket bodies 16 to be fitted together while maintaining the spacing of the pin receiving openings 14 from one socket body to the next. The projection/recess coupling 54 and 56 of the illustrated embodiment is a type of dovetail connection. Other couplings and connectors may, of course, be provided instead. The significant aspect is that the spacing of the pin receiving openings 14 between adjacent socket bodies 16 be preserved.

The cooperating coupling shapes 54 and 56 should fit tightly together to prevent changes in the spacing and positions of the pin receiving openings 14, yet still be readily fastenable and unfastenable with one another. The coupling shapes may be manufactured to such tight tolerances as to accomplish this secure and accurate engagement. However, a simpler approach is to provide a raised portion on the coupling shapes that bears against the adjacent socket body to provide friction and a defined position. One such raised portion is shown in the form of a bump 58, such as the bumps 58 at both sides of the projection 54. Each of the bumps 58 is a rounded projection that extends, in one embodiment, a distance of 0.007 inch from the surface of the socket body 16 in a direction to bear against the adjacent socket body when the two socket bodies are fastened together. The bump 58 provides a friction fit with the adjoining socket body and, further, ensures that the socket bodies do not move or wobble relative to one another. The bumps 58 pressing on both sides of the projection 54 of the coupling shape provide accuracy in the spacing of the pin receiving openings 14 between adjacent socket bodies 16.

The bump 58 is located in a channel 60 at each side of the projection 54 which receives lateral portions 62 of the recess end 56 of an adjoining socket body 16. The lateral portions 62 have an undercut 64 that receives the dovetail shaped projection 54. The bumps 58 may be located at other positions on the end surface of the socket body 16 instead, such as on the projection 54, or on the lateral projections 62. Fewer or more such bumps may be provided within the scope of the present invention. Alternatively, the bumps may project from the recess end 56 of the socket body 16 instead of from the projection end 54. In a further embodiment, the bumps are provided on both the projection surface 54 and the recess surface 56. Other arrangements of bumps, projections, recesses, surface roughening and other means to ensure accurate spacing of the pin receiving openings and/or to provide the proper friction between the adjoined socket bodies are encompassed in the present application.

The ledges 24 extend in the longitudinal direction of the socket assembly 12 only for the length of the main portion of the socket body 16. The ledges 24 stop short of the lateral portions 62 of the coupling shape.

Figure 5:
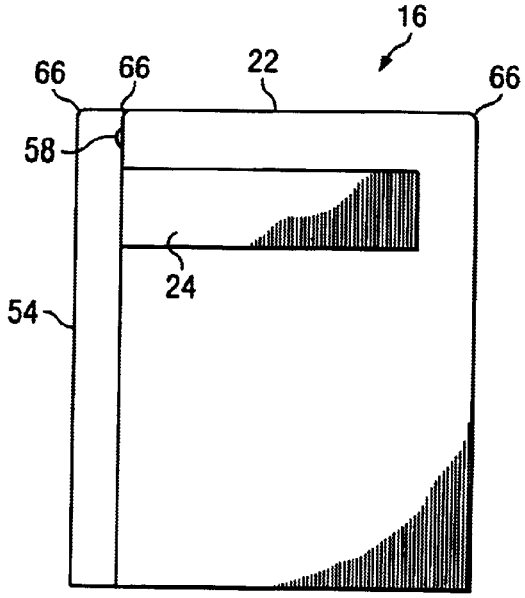
FIG. 5 is a side elevational view of the socket body of FIG. 4.

The side view of FIG. 5 shows the projection 54 of the coupling shape extends the entire vertical height of the socket body 16. The recess 56 (not seen in this view) that receives the projection 54 likewise extends the entire height of the socket body 16. The bump 58 is located near the top 22 of the socket body 16, thus ensuring that the spacing of the pin receiving openings 14 is maintained at the top of the socket assembly 12. Also adjacent the top 22 of the socket body 16 is the ledge 24 on which the work surface 20 rests. If the socket assembly 12 is to be flush with the work surface 20, the ledge 24 is disposed below the top surface 22 of the socket body 16 by the thickness of the work surface material. The ledge 24 does not extend the full length of the socket body 16 in the longitudinal direction of the socket assembly, nor does it need to to support the work surface 20.

The upper edges of the socket body 16 at the coupling portions 54 and 56 are preferably provided with a bevel 66 to permit the socket bodies 16 to be adjoined to one another more easily. The bevel 66 may be, for example, 60 degrees from horizontal. This bevel 66, also referred to as a taper, enables the socket bodies 16 to be fit together tightly without interfering with the initial alignment and initial fitting of the pieces together.

Figure 6:
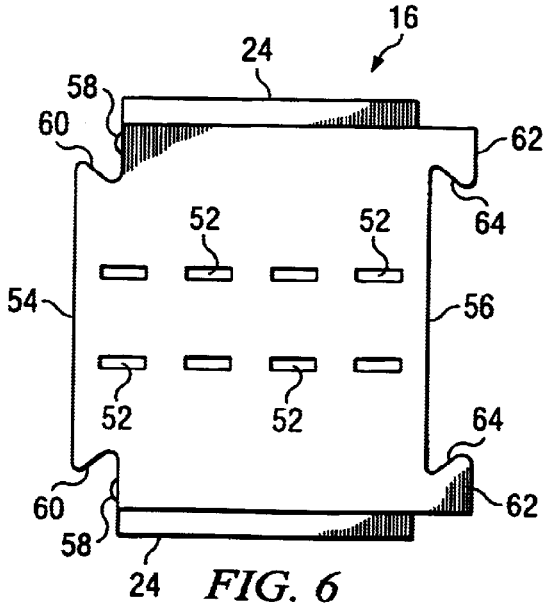
FIG. 6 is a bottom plan view of the socket body of FIG. 4.

The contact connection portions 30 extend through the openings 52 in the bottom surface of the socket body 16, as shown in FIG. 6. The openings 52 are provided in pairs at the bottom of each pin receiving opening 14, as can be seen by comparing FIG. 6 and FIG. 4.

Figure 7:
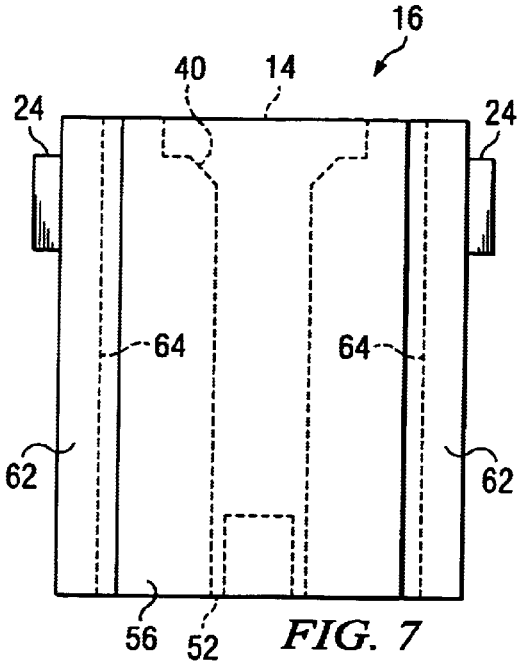
FIG. 7 is an end elevational view of the socket body of FIG. 4.
Figure 9:
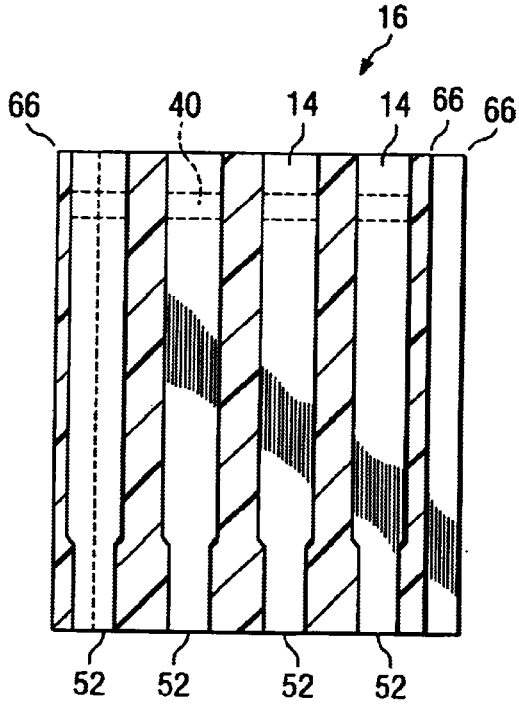
FIG. 9 is a longitudinal cross section through the socket body of FIG. 4.
Figure 8:
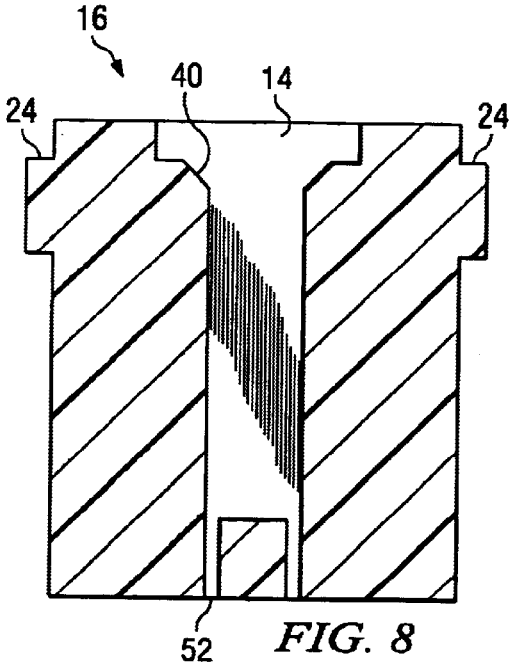
FIG. 8 is a transverse cross section through the socket body of FIG. 4.

FIGS. 7, 8 and 9 set forth the details of the interior of the socket body 16. In particular, the pin receiving openings 14 are shown with the openings 52 extending from the bottom of the pin receiving opening 14 to the bottom surface of the socket body 52. FIG. 7 shows the lateral portions 62 on either side of the recess 56. The undercuts 64 are also indicated.

The openings 52 at the bottom of the pin receiving opening 14 are show in FIG. 7 and in particular in FIG. 8. The openings 52 narrow compared to the width pin receiving openings 14 in the longitudinal direction of the socket assembly, as shown in FIG. 9, so that the contacts 32 are engaged securely and do not slip or loosen.

Figure 10:
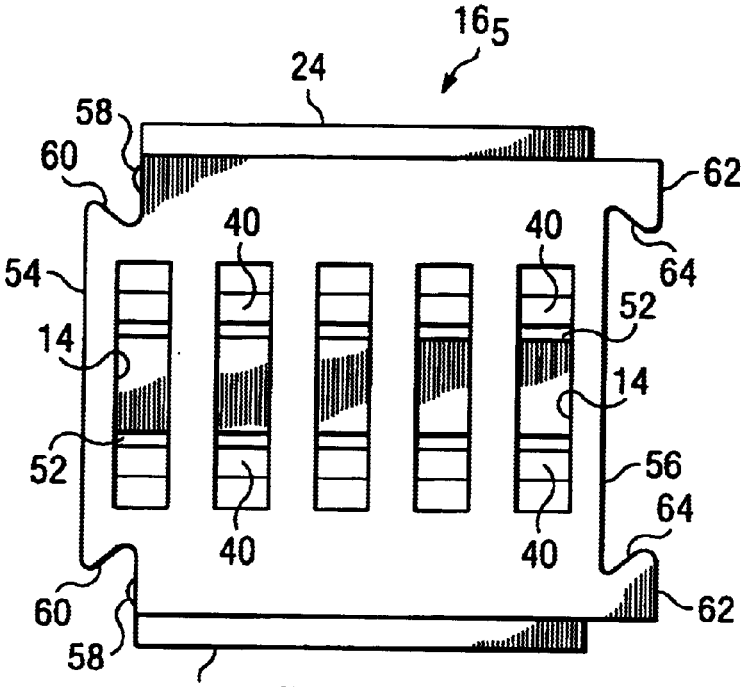
FIG. 10 is a top plan view of a socket body for receiving five pins according to a further embodiment of the present invention.

FIG. 10 shows an embodiment of the socket body $\mathbf{16}_5$ with five pin receiving openings 14. Other features of the socket body $\mathbf{16}_5$ are the same as those of the embodiment 16 (denoted hereinafter as $\mathbf{16}_4$) with four pin receiving openings 14 as shown in FIGS. 4 through 9. Specifically, the coupling portions 54 and 56 are of the same shape and dimensions so that the five pin embodiment $16_5$ can be readily coupled to the four pin embodiment $16_4$. The bumps 58 are in the same positions to maintain the spacing of the pin receiving openings. The ledges 24 extend on the sides of the socket body $16_5$ to support the work surface 20. In other words, the socket body 16*a* is longer than the socket body $16_4$ by the center-to-center spacing of the pin receiving openings 14 and includes an additional pin receiving opening, but is otherwise identical to the socket body $16_4$.

Figure 11:
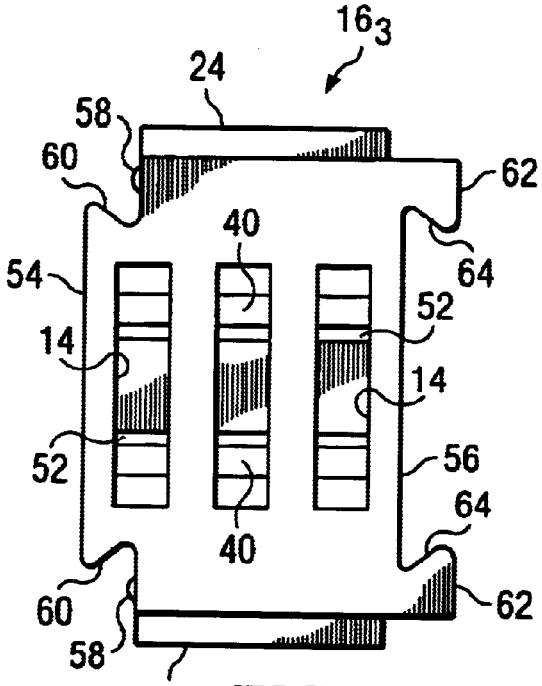
FIG. 11 is a top plan view of a socket body for receiving three pins according to yet another embodiment of the invention.

In FIG. 11 is shown an embodiment of the socket body $16_3$ with three pin receiving openings 14. The socket body $16_3$ is shortened in the longitudinal direction by the center-to-center spacing of the pin receiving openings 14 compared to the four pin receiving opening embodiment $16_4$ and by two such spacings compared to the five pin embodiment $16_5$. The other features of the socket body $16_3$ are identical to that set forth above.

By providing a combination of the three different sizes of socket bodies, in other words, the three opening embodiment $16_3$, the four opening embodiment $16_4$ and the five opening embodiment $16_5$, any number of connection pins may be accommodated from three to as high as desired. In particular, a three pin electrical or electro-mechanical device is connectable in the socket $16_3$ of FIG. 11. A four pin device may be connected in the socket body $16_4$ of FIGS. 4–9. A five pin device may be connected to the socket body $16_5$ of FIG. 10. For greater numbers of pins, the socket bodies $16_3$, $16_4$, and $16_5$ are joined together by affixing the recess 56 and projection 54 portions to one another. For six pins, two three pin socket bodies $16_3$ are joined; for seven pins, a three and a four are joined; and for eight pins, two fours or a five and a three may be joined. Any greater number of pin receiving openings may be provided by combining different ones of the three socket bodies shown.

The ledge 24 provides not only a support for a working surface, but also provides a grip surface during fastening of the socket bodies to one another. It is foreseen that roughened or ridged grip surfaces may be provided on the lateral sides of the socket bodies for this purpose as well.

It is also possible that two pins or one pin may be plugged into the socket bodies have more pin receiving openings than necessary.

The socket bodies are formed of non-conductive material, such as a plastic. In one embodiment, they are formed of 4-6 nylon. The socket bodies are preferably molded by simple techniques to keep costs low, such as by injection molding.

Thus, there is provided a socket body that is connected together with other socket bodies to form a socket assembly, which may have any number of pin receiving openings. The socket assembly may be mounted in a work surface, and the work surface may provide support to a device under test or other device connected to the socket. With the three different socket bodies shown herein, any number of pin connections may be made.

The present socket body accommodates dual in-line pin (DIP) and single in-line pin (SIP) configurations, and may be used with integrated circuit (IC) chips or with modules and circuit subassemblies. For example, power supply subassemblies may be tested prior to installation into the main system. The present invention finds particular utility on the test bench or at the circuit burn-in facility.

Although other modifications and changes may be suggested by those skilled in the art, it is the intention of the inventors to embody within the patent warranted hereon all changes and modifications as reasonably and properly come within the scope of their contribution to the art.

We claim:

1. A plug-in socket for receiving pins of an electrical device, comprising:

a socket body defining pin accepting openings at a first top surface and having a second side surface disposed substantially at a right angle to said first top surface;

contacts mounted in said pin accepting openings so as to contact a pin of the electrical device when inserted therein;

a connecting structure on said second side surface of said socket body, said connecting structure being connectable to a further socket body in side-by-side relation, wherein said socket body has a third side surface disposed substantially at a right angle to said first top surface, wherein said connecting structure is a first connecting structure, and further comprising:

a second connecting structure on said third side surface, said second connecting structure being connectable to a further socket body in side-by-side relation, wherein said second side surface and said third side surface are opposite one another, so that an elongated socket is formed by joining the further socket body to said second end third side surfaces in side-by-side relation, wherein said connecting structure at said second and third side surfaces are dovetail connectors, and wherein said socket body defines a plurality of said pin receiving openings, at least one of said pin receiving openings being in a dovetail part of said dovetail connectors.

* * * * *